United States Patent [19]

Brown

[11] Patent Number: 4,477,292

[45] Date of Patent: Oct. 16, 1984

[54] THREE-STEP AGING TO OBTAIN HIGH STRENGTH AND CORROSION RESISTANCE IN AL-ZN-MG-CU ALLOYS

[75] Inventor: Melvin H. Brown, Freeport, Pa.

[73] Assignee: Aluminum Company of America, Pittsburgh, Pa.

[21] Appl. No.: 311,552

[22] Filed: Oct. 15, 1981

Related U.S. Application Data

[63] Continuation-in-part of Ser. No. 142,541, Apr. 21, 1980, , which is a continuation of Ser. No. 410,109, Oct. 26, 1973, abandoned.

[51] Int. Cl.[3] ..... C22F 1/04

[52] U.S. Cl. ..... 148/20; 148/20.6; 148/159; 148/417

[58] Field of Search ..... 148/159, 12.7 A, 32.5, 148/20, 20.6

[56] References Cited

U.S. PATENT DOCUMENTS 3,856,584 12/1974 Cina ..... 148/159

*Primary Examiner*—R. Dean

*Attorney, Agent, or Firm*—Glenn E. Klepac

[57] ABSTRACT

A three-step thermal aging method for improving the strength and corrosion resistance of an article comprising a solution heat treated aluminum alloy containing zinc, magnesium, copper and at least one element selected from the group consisting of chromium, manganese and zirconium. The article is precipitation hardened at about 175° to 325° F., heat treated for from several minutes to a few hours at a temperature of about 360° to 390° F. and again precipitation hardened at about 175° to 325° F. In a preferred embodiment the article treated comprises aluminum alloy 7075 in the T6 condition. The method of the invention is easier to control and is suitable for treating articles of greater thickness than other comparable methods.

13 Claims, 1 Drawing Figure

THREE-STEP AGING TO OBTAIN HIGH STRENGTH AND CORROSION RESISTANCE IN AL-ZN-MG-CU ALLOYS

CROSS-REFERENCE TO RELATED APPLICATION

This application is a continuation-in-part of U.S. application Ser. No. 142,541, filed Apr. 21, 1980, which application is a continuation of U.S. application Ser. No. 410,109, filed Oct. 26, 1973, abandoned.

BACKGROUND OF THE INVENTION

The present invention relates to a method for thermally treating articles containing an alloy based on aluminum.

Various methods have been developed in the prior art for improving the resistance to corrosion under certain service conditions of the precipitation hardened condition of aluminum alloy 7075. This condition is referred to as the T6 condition of alloy 7075. However, none of these prior art methods is completely suitable for its intended purpose.

For example, Sprowls et al U.S. Pat. No. 3,198,676 describes a two-step method for improving the resistance of precipitation hardened 7075 alloy to stress-corrosion cracking. Aluminum alloy treated according to the method of the Sprowls et al patent is in a condition that is referred to as the T73 temper. Aluminum 7075 alloy in the T73 temper has improved resistance to stress-corrosion cracking although the T73 temper decreases tensile strength significantly compared with the T6 condition.

Specimens of commercially prepared aluminum 7075 alloy in the T73 temper have sometimes been subjected to a third aging step in order to increase tensile strength and yield strength. For example, a 7075 specimen subjected to precipitation hardening for six hours at 225° F. and heat treatment for eight hours at 350° F. had a tensile strength of 72 ksi (kilopounds per square inch) and a yield strength of 61 ksi. Further precipitation hardening for 48 hours at 250° F. increased tensile strength to 76 ksi and yield strength to 66 ksi. Resistance to stress-corrosion cracking was retained. Although the time of the heat treatment step has been varied between six hours and nine hours in this procedure, applicant is not aware of any prior art three-step aging process wherein the times and temperatures for the second (heat treatment) step correspond to the times and temperatures for the second step of the three-step process described and claimed herein.

Another prior art two-step method for heat treating aluminum alloys is disclosed in Nock et al U.S. Pat. No. 2,248,185. The times and heat treating temperatures described for both of the steps of the Nock et al method are comparable to the times and temperatures employed in the first two steps of the method of the present invention. However, the Nock et al patent does not suggest addition of a third, precipitation hardening step.

Cina U.S. Pat. No. 3,856,584 describes a method that is claimed to reduce the susceptibility to stress-corrosion cracking of 7000 series aluminum alloys. Alloys are successively subjected to a solution heat treatment, an age hardening step at a lower temperature than the heat treatment step, a "retrogression" heat treatment for a few seconds to a few minutes at a temperature of 200° to 260° C. and a reaging heat treatment at a temperature of 115° to 125° C. The thermal aging method of the present invention differs from the method claimed by Cina in that Cina's "retrogression" heat treatment is carried out at higher temperatures than are preferred herein. The present method has the advantages of being easier to control and being suitable for treatment of articles having greater thicknesses than Cina's method.

SUMMARY OF THE INVENTION

An object of the present invention is to provide a new heat treating method to produce an aluminum alloy in a unique heat treated condition providing favorable resistance to corrosion combined with high tensile strength.

It is a related object of the invention to provide a method for heat treating aluminum alloy that is easier to control then comparable prior art methods.

A further object of the invention is to provide a method for heat treating aluminum alloy that is suitable for treating articles of greater thickness than other comparable methods.

The foregoing objects are achieved according to the present invention by thermally treating an article comprising a solution heat treated alloy of the 7000 series, said alloy containing aluminum, zinc, magnesium, copper and at least one element selected from the group consisting of chromium, manganese and zirconium. The method comprises the steps of precipitation hardening the article at about 175° to 325° F., heat treating the article for from several minutes to a few hours at about 360° to 390° F. and again precipitation hardening the article at about 175° to 325° F. In a preferred embodiment, the heat treating step is carried out at a time and temperature within the perimeter of ABCDE in FIG. 1.

DESCRIPTION OF A PREFERRED EMBODIMENT

Figure 1:
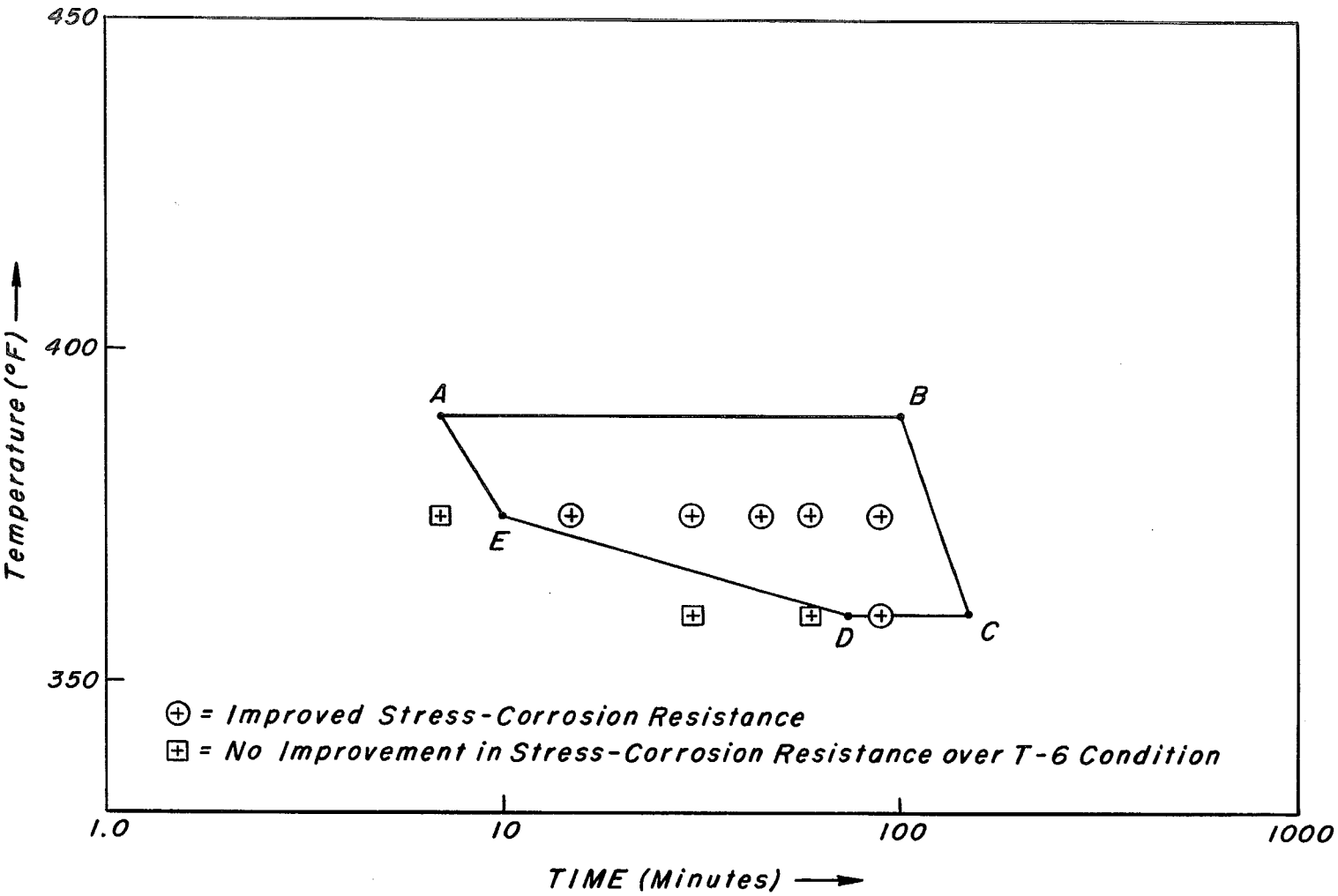
FIG. 1 is a graph showing some preferred times and temperatures for the heat treating step of the method of the invention.

Alloys treated by the method of the present invention contain aluminum, zinc, magnesium, copper and at least one other element selected from the group consisting of chromium, manganese and zirconium. Some composition ranges for these 7000 series aluminum alloys are as follows: 4 to 8% zinc; 1.5 to 3.5% magnesium; 1 to 2.5% copper; at least one element selected from the group made up of 0.05 to 0.3% chromium, 0.1 to 0.5% manganese and 0.05 to 0.3% zirconium; balance aluminum.

Alloys designated 7075 by the aluminum industry are preferred for the present invention and have a composition containing 5.1 to 6.1% zinc, 2.1 to 2.9% magnesium, 1.2 to 2.0% copper, 0.18 to 0.35% chromium, 0.30% maximum manganese, 0.40% maximum silicon, 0.50% maximum iron, 0.20% maximum titanium, others each 0.05% maximum and others total 0.15% maximum, balance aluminum.

The alloys used in the present invention may also contain one or more of the group of grain refining elements including titanium at 0.01 to 0.2% and boron at 0.0005 to 0.002%. These elements serve to produce a fine grain size in the cast form of the alloy. This is generally advantageous to mechanical properties.

In addition, it may be helpful to add 0.001 to 0.005% beryllium for the purpose of minimizing oxidation at times when the alloy is molten.

Iron and silicon are generally present as impurities. Up to 0.5% iron can be tolerated, and the silicon content should not exceed 0.4% in order to avoid the formation of any substantial amount of the intermetallic compound $Mg_2Si$.

A preferred heat treatment according to the present invention for obtaining improved stress-corrosion resistance is to immerse aluminum alloy, as above defined, in the precipitation hardened, T6 condition into molten metal for a time and temperature within the perimeter of the outline ABCDE in FIG. 1, then precipitation harden again.

In its broader aspects, a T6 condition may be obtained by precipitation hardening solution heat treated alloy at 175° to 325° F. Typical conditions may be:

(a) For alloys containing less than 7.5% zinc, heating a solution heat treated article to 200° to 275° F. and holding for a period of 5 to 30 hours;

(b) For alloys containing more than 7.5% zinc, heating a solution heat treated article to 175° to 275° F. and holding for a period of 3 to 30 hours.

A usual practice for obtaining the T6 condition is to heat a specimen for 24 hours at 250° F. in a circulatory air furnace.

In accordance with the present invention, an article comprising a solution heat treated aluminum alloy of the 7000 series is precipitation hardened at about 175° to 325° F., then subjected to a temperature and time within the perimeter of the outline ABCDE in FIG. 1, and then again precipitation hardened at about 175° to 325° F.

In a particularly preferred embodiment, the initial precipitation hardening step is carried out for a period of 24 hours at about 250° F. The heat treatment step is preferably conducted for about 45 to 90 minutes at a temperature of about 375° F. The final precipitation hardening step is preferably carried out for about 6 to 12 hours at a temperature of about 275° to 300° F.

It is an advantage of the present invention that the thermal aging method described herein is suitable for use with specimens having greater maximum thicknesses than previously published thermal aging methods having a heat treating step conducted at higher temperatures. The following equation, derived from heat transfer theory, describes the maximum suitable thickness in inches for an article having a heat treating step performed in accordance with the invention:

$$L = 0.2 + 0.54\left[\frac{480 - T}{100}\right]^{3.75}[h_T]^{0.56}$$

In the above equation, L is the thickness of the article in inches, T is the temperature in degrees Fahrenheit of the heat treating medium and $h_T$ is the coefficient of heat transfer between the heat treating medium and the article in BTU/(hr)(sq.ft.)(deg.F.). Gurney-Lurie charts (reprinted in W. H. McAdams, *Heat Transmission*, 1st Edition 1933, pp. 30–35) were used to develop this equation for combinations of thickness, temperature and heat transfer that would allow enough time to heat and cool aluminum 7075 alloy articles within the time and temperature constraints shown in FIG. 1.

Applying the above equation to the condition wherein the heat treating medium is air and the article is composed of aluminum 7075 alloy, the article may have a maximum thickness of about 1.5 inches at 390° F., about 2.2 inches at 380° F., about 3.0 inches at 370° F. and about 4.1 inches at 360° F. Air is the preferred heat treating medium for commercial applications although molten metal or mineral oil may be used for more precise temperature control. When the heat treating medium is a molten metal and the article is composed of aluminum 7075 alloy, the article may have a maximum thickness of about 17.9 inches at a heat treating temperature of 390° F., about 26.5 inches at 380° F., about 37.8 inches at 370° F. and about 52.3 inches at 360° F. When the heat treating medium is mineral oil and the article is composed of aluminum 7075 alloy, the article may have a maximum thickness of about 5.0 inches at a heat treating temperature of 390° F., about 7.4 inches at 380° F., about 10.5 inches at 370° F. and about 14.5 inches at 360° F. Heat treatment of articles having maximum thicknesses in excess of those allowed by the above equation is likely to result in either insufficient heat treatment for a central portion of the article or excessive heat treatment for outer portions of the article which might result in diminished strength.

EXAMPLES

Specimens of aluminum alloy 7075 in the T6 condition were treated by the method of the invention and tested for stress-corrosion resistance. All specimens tested had the composition shown in Table 1.

TABLE 1

| Composiition of Specimens | |
|---|---|
| Element | Proportion in Wt. % |
| Cu | 1.63 |
| Fe | .30 |
| Si | .12 |
| Mn | .07 |
| Mg | 2.48 |
| Zn | 5.68 |
| Cr | .19 |
| Ti | .05 |
| Be | .001 |
| Al | Remainder |

To determine stress-corrosion resistance, short-transverse ⅛-inch (3.2 mm) diameter specimens were stressed in constant strain fixtures. The fixtures are described in ASTM Special Technical Publication No. 425, *Stress Corrosion Testing*, July 1966, Stress-Corrosion Testing Methods, Report of Task Group I, pp. 3–20. Specimens in the T6 condition were used as controls. Both the control and test specimens were exposed by an alternate immersion test comprising ten minutes immersion in 3.5% aqueous NaCl solution and a 50-minute drying cycle. Stresses were maintained constant at 42 ksi (kilopounds per square inch) throughout the tests. Test results are summarized in Tables 2 and 3.

TABLE 2

| $t_1$ hr | $T_1$ °F. | $t_2$ min | $T_2$ °F. | $t_3$ hr | $T_3$ °F. | T.S. ksi(2) | Y.S. ksi(3) | Y.S./Y.S.T6 (4) | Days to Failure(5) |
|---|---|---|---|---|---|---|---|---|---|
| 24 | 250(1) | — | — | — | — | 72.2 | 64.5 | 1.00 | 2 |
| 24 | 250 | 7 | 375 | 24 | 250 | 71.8 | 63.5 | 0.98 | 3 |
| 24 | 250 | 15 | 375 | 24 | 250 | 71.8 | 63.7 | 0.99 | 37 |
| 24 | 250 | 30 | 375 | 24 | 250 | 70.3 | 63.2 | 0.98 | 45 |
| 24 | 250 | 45 | 375 | 24 | 250 | 67.1 | 58.4 | 0.91 | 80 |
| 24 | 250 | 60 | 375 | 24 | 250 | 68.2 | 60.7 | 0.94 | 54 |
| 24 | 250 | 90 | 375 | 24 | 250 | 67.1 | 58.1 | 0.90 | 66 |
| 24 | 250 | 30 | 360 | 24 | 250 | 72.7 | 64.4 | 1.00 | 2 |
| 24 | 250 | 60 | 360 | 24 | 250 | 71.4 | 62.9 | 0.98 | 2 |
| 24 | 250 | 90 | 360 | 24 | 250 | 70.0 | 61.4 | 0.95 | 59 |
| 24 | 250 | 120 | 360 | 24 | 250 | 69.2 | 61.6 | 0.96 | 52 |

TABLE 2-continued

| $t_1$ hr | $T_1$ °F. | $t_2$ min | $T_2$ °F. | $t_3$ hr | $T_3$ °F. | T.S. ksi(2) | Y.S. ksi(3) | Y.S./Y.S.T6 (4) | Days to Failure(5) |
|---|---|---|---|---|---|---|---|---|---|
| 24 | 250 | 150 | 360 | 24 | 250 | 67.1 | 59.5 | 0.92 | 81 |

(1)T6 temper
(2)Tensile strength, kilopounds per square inch
(3)Yield strength, kilopounds per square inch
(4)Ratio of yield strength of test specimen to yield strength of specimen with T6 temper
(5)Specimens exposed by alternate immersion in 3.5% NaCl solution and stressed to 42 ksi Results of the tests of Table 2 are illustrated in FIG. 1. Specimens subjected to a preferred heat treating step in accordance with the present invention exhibit increased stress-corrosion resistance. The time and temperature relationships of such preferred heat treating step are within the perimeter of outline ABCDE in FIG. 1. Time and temperature relationships for the heat treating step outside the perimeter of outline ABCDE resulted in no significant increase in stress-corrosion resistance compared with the T6 condition.

TABLE 3

| $t_1$ hr | $T_1$ °F. | $t_2$ min | $T_2$ °F. | $t_3$ hr | $T_3$ °F. | T.S. ksi(1) | Y.S. ksi(2) | Y.S./Y.S.T6 (3) | Days to Failure(4) |
|---|---|---|---|---|---|---|---|---|---|
| 24 | 250 | 60 | 375 | 6 | 275 | 75.3 | 71.8 | 1.11 | 11 |
| 24 | 250 | 60 | 375 | 6 | 300 | 74.2 | 69.9 | 1.08 | 10 |
| 24 | 250 | 60 | 375 | 12 | 275 | 73.4 | 69.1 | 1.07 | 8 |
| 12 | 275 | 60 | 375 | 12 | 275 | 72.2 | 68.5 | 1.06 | 11 |
| 6 | 275 | 60 | 375 | 24 | 250 | 72.3 | 68.4 | 1.06 | 14 |
| 4 | 300 | 60 | 375 | 4 | 300 | 70.8 | 65.9 | 1.02 | 21 |
| 2 | 300 | 60 | 375 | 2 | 300 | 69.2 | 64.7 | 1.00 | 58 |
| 24 | 250 | 60 | 375 | 24 | 250 | 78.4 | 64.2 | 1.00 | 48 |
| 6 | 300 | 60 | 375 | 6 | 300 | 69.4 | 63.3 | 0.98 | 40 |
| 6 | 300 | 60 | 375 | 24 | 250 | 68.2 | 62.5 | 0.97 | 56 |
| 18 | 275 | 60 | 375 | 18 | 275 | 68.9 | 62.5 | 0.97 | 47 |
| 12 | 275 | 60 | 375 | 24 | 250 | 69.0 | 61.6 | 0.96 | 9 |
| 4 | 300 | 60 | 375 | 8 | 300 | 67.7 | 61.5 | 0.96 | 54 |
| 24 | 250 | 60 | 375 | 24 | 250 | 69.8 | 60.7 | 0.94 | 73 |
| 8 | 300 | 60 | 375 | 4 | 300 | 67.7 | 60.6 | 0.94 | 36 |
| 24 | 250 | 90 | 375 | 6 | 275 | 71.9 | 66.4 | 1.03 | 40 |
| 6 | 275 | 90 | 375 | 24 | 250 | 69.6 | 63.7 | 0.99 | 45 |
| 12 | 275 | 90 | 375 | 12 | 275 | 69.1 | 63.4 | 0.98 | 42 |
| 6 | 275 | 90 | 375 | 6 | 275 | 68.3 | 61.4 | 0.95 | 38 |
| 24 | 250 | 90 | 375 | 24 | 250 | 67.1 | 58.1 | 0.90 | 66 |

(1)Tensile strength, kilopounds per square inch
(2)Yield strength, kilopounds per square inch
(3)Ratio of yield strength of test specimen to yield strength of specimen with T6 temper
(4)Specimens exposed by alternate immersion in 3.5% NaCl solution and stressed to 42 ksi The test results in Table 3 are arranged in order of decreasing yield strength for second-step (heat treating) aging of 60 and 90 minutes at 375° F. with conditions of the first and third (precipitation hardening) steps being varied. These data indicate that highest yield strengths were obtained by treating the specimens for 24 hours at 250° F. in the first step and for 6 to 12 hours at 275° to 300° F. in the third step.

While the foregoing description of my invention has been made with respect to a preferred embodiment, persons skilled in the art will understand that numerous changes and modifications may be made therein without departing from the spirit and scope of the following claims.

What is claimed is:

1. In a method for heat treating an article comprising a solution heat treated aluminum alloy of the 7000 series, said alloy containing aluminum, zinc, magnesium, copper and at least one element selected from the group consisting of chromium, manganese and zirconium, said method comprising the steps of (a) precipitation hardening the article at about 175° to 325° F.;

(b) heat treating the article by immersing it in a heat treating medium; and (c) precipitation hardening the article at about 175° to 325° F.;

the improvement wherein step (b) is carried out for about 10 minutes to a few hours at a temperature of about 360° to 375° F., said method thereby being suitable for treatment of articles having greater maximum thickness than methods in which step (b) is carried out at greater than 390° F.

2. The method of claim 1 wherein step (b) is carried out at a time and temperature within the perimeter of ABCDE of FIG. 1 and consistent with the limitations of claim 1.

3. The method of claim 2 wherein step (b) is carried out at a temperature of about 375° F. for about 45 to 90 minutes.

4. The method of claim 1 wherein step (b) is carried out for about 10 to 150 minutes.

5. The method of claim 1 wherein step (a) is carried out for about 24 hours at a temperature of about 250° F.

6. The method of claim 5 wherein step (c) is carried out for about 6 to 12 hours at a temperature of about 275° to 300° F.

7. The method of claim 1 wherein steps (a) and (c) are each carried out for about 2 to 30 hours.

8. The method of claim 1 wherein the maximum thickness of said article in inches is given by the formula $$0.2 + 0.54\left[\frac{480 - T}{100}\right]^{3.75}[h_T]^{0.56}$$

wherein T is the temperature in degrees Fahrenheit of the heat treating medium, and $h_T$ is the coefficient of heat transfer between the heat treating medium and the article in BTU/(hr)(sq.ft.)(deg.F.).

9. The method of claim 8 wherein the heat treating medium is air, and at least a portion of the article has a maximum thickness of about 3.0 inches at 370° F. and about 4.1 inches at 360° F.

10. The method of claim 8 wherein the heat treating medium is mineral oil, and at least a portion of the article has a maximum thickness of about 10.5 inches at 370° F. and about 14.5 inches at 360° F.

11. The method of claim 8 wherein the heat treating medium is a molten metal, and at least a portion of the article has a maximum thickness of about 37.8 inches at 370° F. and about 52.3 inches at 360° F.

12. In a method for heat treating an article comprising a solution heat treated aluminum 7075 alloy, said method comprising the steps of (a) precipitation hardening the article for about 24 hours at about 250° F.;

(b) heat treating the article by immersing it in a heat treating medium; and (c) precipitation hardening the article for about 6 to 12 hours at about 275° to 300° F.;

the improvement wherein step (b) is carried out for about 45 to 90 minutes at about 375° F., said method thereby being suitable for treatment of articles having greater maximum thickness than methods in which step (b) is carried out at greater than 390° F.

13. The method of claim 1 wherein said article comprises an aluminum 7075 alloy.

* * * * *